US005922130A

United States Patent [19]

Mosser et al.

[11] Patent Number: 5,922,130

[45] Date of Patent: Jul. 13, 1999

[54] SPRAY BOOTH FOR APPLYING COATINGS TO SUBSTRATE

[75] Inventors: Mark F. Mosser, Perkiomenville; Bruce McMordie, Perkasie, both of Pa.

[73] Assignee: Sermatech International, Inc., Limerick, Pa.

[21] Appl. No.: 08/829,654

[22] Filed: Mar. 31, 1997

[51] Int. Cl.[6] ..... B05B 15/12; B05C 5/00

[52] U.S. Cl. ..... 118/326; 118/665; 118/688; 118/689; 118/DIG. 7; 34/557; 454/50; 454/51; 454/52; 454/53; 454/63; 55/DIG. 46; 95/11; 95/12; 96/399; 96/407; 96/413

[58] Field of Search ..... 118/326, 665, 118/688, 689, DIG. 7; 34/557; 454/50, 51, 52, 53, 63; 55/DIG. 46; 95/11, 12; 96/399, 407, 413

[56] References Cited

U.S. PATENT DOCUMENTS

| | | | |
|---|---|---|---|
| 1,520,267 | 12/1924 | Waltz . | |
| 1,907,389 | 5/1933 | McCoy . | |
| 2,761,373 | 9/1956 | Owen . | |
| 3,772,851 | 11/1973 | Duffey | 55/1 |
| 3,963,461 | 6/1976 | Stockford et al. | 55/20 |
| 4,048,912 | 9/1977 | Walker . | |
| 4,127,106 | 11/1978 | Jensen . | |
| 4,133,255 | 1/1979 | Guice . | |
| 4,173,924 | 11/1979 | Bradshaw . | |
| 4,230,032 | 10/1980 | Perryman . | |
| 4,257,783 | 3/1981 | Gutjahr et al. | 55/61 |
| 4,261,256 | 4/1981 | Joret . | |
| 4,266,504 | 5/1981 | Roesner . | |
| 4,292,052 | 9/1981 | Cardullo | 55/19 |
| 4,313,369 | 2/1982 | Tsuruta et al. . | |
| 4,338,364 | 7/1982 | Kennon et al. . | |
| 4,351,863 | 9/1982 | Roesner . | |
| 4,367,787 | 1/1983 | Bradshaw . | |
| 4,521,227 | 6/1985 | Gerdes et al. . | |
| 4,530,272 | 7/1985 | Stokes | 98/34.5 |
| 4,544,380 | 10/1985 | Itou et al. | 55/80 |
| 4,590,847 | 5/1986 | Hull . | |
| 4,616,594 | 10/1986 | Itho . | |
| 4,649,710 | 3/1987 | Inoue et al. . | |
| 4,653,387 | 3/1987 | Osawa et al. . | |
| 4,664,061 | 5/1987 | Morioka et al. . | |
| 4,687,686 | 8/1987 | Stofleth et al. . | |
| 4,701,193 | 10/1987 | Robertson et al. | 55/217 |
| 4,923,484 | 5/1990 | Saito | 55/21 |
| 4,926,746 | 5/1990 | Smith . | |
| 5,095,811 | 3/1992 | Shutic et al. | 454/52 |
| 5,127,574 | 7/1992 | Mosser et al. | 236/44 |
| 5,133,690 | 7/1992 | Bowe | 454/51 |
| 5,356,334 | 10/1994 | Gray | 454/51 |
| 5,395,285 | 3/1995 | Milton | 454/52 |
| 5,458,673 | 10/1995 | Kojima et al. | 95/11 |
| 5,688,308 | 11/1997 | Voigts | 96/18 |
| 5,746,650 | 5/1998 | Johnson et al. | 454/52 |

FOREIGN PATENT DOCUMENTS

| | | | |
|---|---|---|---|
| 0 253 980 | 1/1988 | European Pat. Off. . | |
| 2525926 | 11/1983 | France . | |
| 519005 | 2/1931 | Germany . | |
| 5-277408 | 10/1993 | Japan | 118/326 |
| 630 271 A5 | 6/1982 | Switzerland . | |

*Primary Examiner*—Peter Chin
*Assistant Examiner*—Michael P. Colaianni
*Attorney, Agent, or Firm*—Weiser and Associates, P.C.

[57] ABSTRACT

A spray booth includes an outer enclosure in which the temperature and humidity of a fluid (such as air) is not controlled and a fluid handling unit within this enclosure, which circulates and controls the temperature and humidity of a smaller volume of the same fluid (air) to develop an environment suitable for application of coatings to desired substrates. In use, fluid is drawn from the outer enclosure into the inner, fluid handling unit in order to clean and modify the temperature and humidity of the fluid being handled, conditioning it to be delivered to the region of limited size which is established for receiving the substrate to be coated.

36 Claims, 5 Drawing Sheets

SPRAY BOOTH FOR APPLYING COATINGS TO SUBSTRATE

BACKGROUND OF THE INVENTION

The present invention generally relates to spray booths of use in applying coatings to desired substrates. More particularly, the present invention relates to a spray booth for applying coatings to substrates under conditions where the temperature and/or humidity of the environment established within the spray booth must be controlled to ensure coating quality.

Various types of substrates are coated with various types of coatings, and in each case, the environment surrounding the substrate must be effectively controlled to ensure the quality of the coating. For example, automotive parts, aerospace parts, and appliance parts have various types of coatings applied to them. Coatings such as paints, base coats, top coats, and aqueous metallic slurries may be applied to these parts to achieve various benefits.

As an example, U.S. Pat. No. 3,248,251 (Allen) discloses metal filled aqueous chromate/phosphate slurries. These slurries are commonly used on aerospace parts to impart a desired quality finish to the surface of the part. The quality of the finish is directly related to the environment in which the part is coated.

The quality of any finish (of an applied paint or other coating) depends upon the cleanliness of the environment in which it is applied. With regard to waterborne materials, such as are described in U.S. Pat. No. 3,248,251 the moisture content of the environment can also exert a significant influence upon the affecting deposition rate, drying rate and more. For this reason it is often important to control humidity and/or temperature of the environment in which a coating is being applied.

There are also environmental concerns related to the application of such coatings. For example, chromate/phosphate slurries and aluminum filled chromate/phosphate coatings are widely used in aerospace applications. The chemical stability of the slurry composition and the corrosion resistance of the binder system of these coatings are a consequence of the presence of hexavalent chromium in the material. Hexavalent chromium is environmentally toxic and its levels must be controlled during application. Control is particularly critical when the coating films are deposited on parts by air spray techniques.

It was therefore desirable to provide a spray booth for applying coatings such as those discussed above, which spray booth could control the environment around the part being coated. This would serve to facilitate the reproducible deposition of uniform, tightly adherent, smooth coatings.

Early spray booths which controlled the spraying environment were expensive and inefficient devices in which large volumes of fluid (especially air) were subjected to heating, cooling, and humidity control, as appropriate for a particular application and moved through the working area at high speeds.

To minimize the amount of work the fluid was typically recirculated in these devices. However, this recirculated air passed by and around the operator, resulting in problems with Federal air/workplace regulations.

Recognizing this, efforts were made to reduce the cost of controlling temperature and humidity in the working fluid by limiting the amount being treated to that only in the vicinity of the part being coated. Ambient air was passed through a humidity and/or temperature control apparatus then directly over the substrate to be coated, creating a controlled region or curtain of condition of a size sufficient to surround the part being coated, but less than the total size of the room receiving such equipment.

To this end, U.S. Pat. No. 5,127,574 (Mosser et al.) discloses a spray booth for applying coatings to substrates which is defined by an outer chamber containing a fluid (such as air) at a first temperature and/or humidity, and an inner chamber positioned within and in fluid communication with the outer chamber, capable of handling the fluid to develop a limited and controlled environment for receiving substrates to be coated.

The inner chamber is caused to operate continuously at a second humidity and/or temperature higher than that of the temperature and/or humidity in the outer enclosure. This is achieved by recirculating the flow of fluid in the inner chamber and continuously adjusting its temperature and/or humidity to a predetermined level.

Appropriate filters remove airborne contaminants from the recirculating fluid. Means are also provided for exhausting desired amounts of the fluid from the inner chamber to the environment external of the outer chamber.

In operation, the outer chamber is maintained at a first temperature and/or humidity responsive to the operation of appropriate air handling equipment (which can include air cleaning equipment if desired). Fluid is drawn from this outer chamber, into the inner chamber to modify the temperature and/or humidity of the fluid handled by the inner chamber (to achieve the second temperature and/or humidity) at a rate equal to or greater than the rate at which fluid is exhausted from the inner chamber to the environment external to the outer chamber.

The system disclosed in U.S. Pat. No. 5,127,574 provides better control of the process environment around a component, especially as relates to spraying a coating in air, than possible in any of the prior art, provided that:

- there is an outer enclosure in which conditions of the process fluid (air), for example, its temperature and humidity, are precisely controlled; and
- the part to be processed is completely encapsulated within the working fluid being recirculated within the inner loop.

SUMMARY OF THE INVENTION

It is the primary objective of this invention to provide a spray booth which focuses clean air of a controlled temperature and humidity immediately on a substrate to be painted without requiring that the same cleanliness, temperature and humidity be maintained in the air surrounding the booth or on any parts of the substrate which rest outside of the booth. These innovations significantly reduce costs associated with creating and maintaining controlled environments especially during sensitive operations performed on elongate substrates such as large assemblies or individual components.

It is also an object of the present invention to provide a spray booth for use in the application of coatings to substrates which can operate within an enclosure which does not require temperature and/or humidity control, in turn reducing the costs associated with providing such control.

It is also an object of the present invention to provide a spray booth for use in the application of coatings to substrates which can operate in a more versatile enclosure, including structured and temporary enclosures, as well as field installations.

It is also an object of the present invention to provide a spray booth for use in the application of coatings to substrates which is capable of developing a controlled environment of limited size, yet which is capable of use in conjunction with widely differing substrates and coatings.

It is also an object of the present invention to provide a spray booth for use in the application of coatings to substrates which are larger in size than the controlled environment developed by the spray booth.

These and other objects which will become apparent are achieved in accordance with the present invention by providing an outer enclosure for containing a fluid (such as air) in an environment which is as clean and dust free as possible, but which is not regulated in terms of its temperature and/or humidity for purposes of establishing an environment suitable for the application of coatings, and a fluid handling unit located within the outer enclosure for developing a controlled environment suitable for the application of coatings to desired substrates. The fluid handling unit develops this controlled environment between an inlet which is preferably positioned over the controlled environment, and an outlet which is preferably positioned beneath the controlled environment. The inlet and the outlet are connected by appropriate fluid handling equipment. Such fluid handling equipment may include means for heating the fluid, means for cooling the fluid, means for elevating humidity and/or means for reducing humidity, in desired combinations. Such equipment also preferably includes suitable filters for removing airborne contaminants and the like, as well as means for exhausting desired amounts of the fluid from the inner handling unit to the environment external of the outer enclosure.

In operation, fluid is recirculated within the inner fluid handling unit. Temperature and/or humidity of the fluid is modified by the equipment according to conditions required by the process to be performed. This fluid, which is now controlled in terms of its temperature and/or humidity, is then delivered to the region of limited size in which the coating is being applied, passes through this region, and is extracted along with any fluid borne residues such as solvents and/or overspray, to be filtered, solvent absorbed, and recirculated.

A portion of the fluid recirculating within the inner chamber is exhausted outside of the outer enclosure. This exhausted volume of fluid is replaced by fluid drawn from the outer enclosure which encroaches into the inner loop. The amount of intermingling of fluids in the inner chamber and outer enclosure is controlled by adjusting the amount of fluid exhausted from the inner chamber.

The temperature and/or humidity of the environment established within the outer enclosure need not be controlled, significantly reducing the fluid handling equipment required for the overall installation and significantly reducing the costs of operating such fluid handling equipment. Nevertheless, a carefully controlled environment is established for receiving a substrate to be coated while ensuring an effective result.

For further detail regarding the improvements of the present invention, reference is made to the detailed description which is provided below, taken in conjunction with the following illustrations.

DETAILED DESCRIPTION OF PREFERRED EMBODIMENTS

Figure 1:
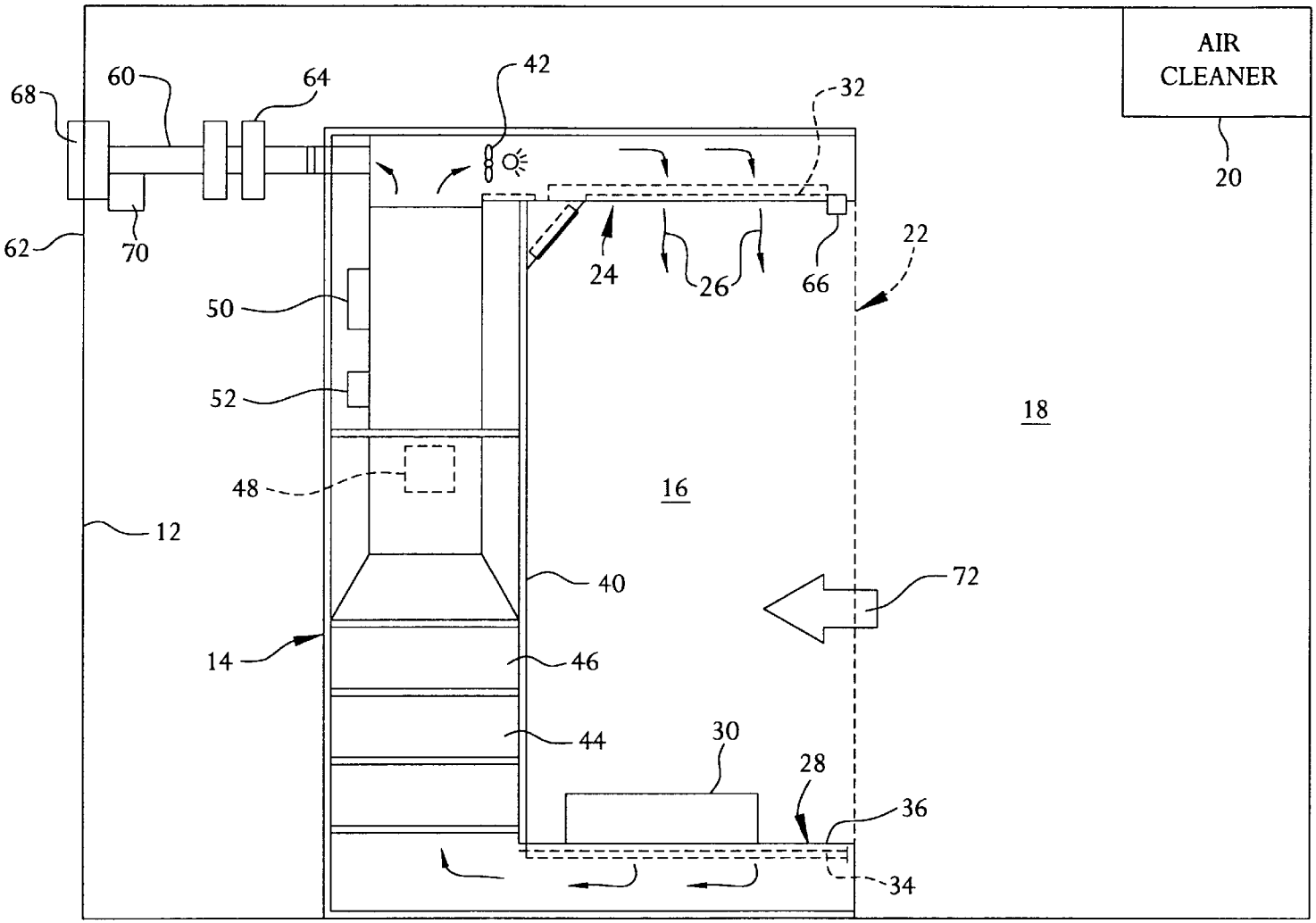
FIG. 1 shows a side elevational view of a spray booth produced in accordance with the present invention.

FIG. 1 shows a spray booth 10 for applying coatings to substrates in accordance with the present invention. The spray booth 10 is defined by an outer enclosure (generally indicated at 12) and an inner, fluid handling unit (generally indicated at 14). The outer enclosure 12 contains a fluid, such as air, having a temperature and humidity which will primarily depend upon the surrounding environment within which the outer enclosure 12 is located. The inner, handling unit 14 defines a region (generally indicated at 16) for receiving a substrate to be coated. The region 16 will be controlled in temperature and/or humidity as will be discussed more fully below. However, it will be noted that the outer enclosure 12 defines a region 18 which is significantly larger than the region 16 defined by the handling unit 14. In accordance with the present invention, the fluid in region 18 defined within the outer enclosure 12 need not be environmentally controlled in terms of cleanliness, temperature and/or humidity. This in turn provides a significant benefit in terms of equipment capacity and operating cost since the volume of air handled in the outer enclosure 12 is significantly larger (preferably at least twice as large) than the volume of air handled by the handling unit 14. In practice, the size of the outer enclosure 12 will be much larger relative to the handling unit 14, leading to the potential for even greater savings.

Although it is not necessary to regulate the temperature and/or humidity of the air contained by the outer enclosure 12, it remains important to minimize airborne contaminants within the outer enclosure 12, preferably controlling the air to at least a level of a class 200,000 clean room as described in Federal Standard 209, which is incorporated herein by reference. An air cleaning apparatus 20 of known type and capacity may be provided to establish the necessary conditions, as appropriate. However, the costs associated with providing such an environment are small relative to the more significant costs of maintaining a controlled temperature and/or humidity within the outer enclosure 12. The temperature and/or humidity in the outer enclosure 12 can be described as ambient, these can vary over a wide range depending where the spray booth will be in operation, whether in tropical or very cold climates, dry or humid conditions. For instance the temperature may vary from 125° F. to 0° F. or lower and the relative humidity from 15 to 95%.

The handling unit 14, which operates within the fluid of region 18, generally includes walls, a top and a bottom, forming a region (the region 16) which is open to the outer enclosure 12. The fluid in handling unit 14 (the fluid of region 16) is in communication with the outer enclosure 12 (and the fluid of region 18) through an opening 22 in the handling unit 14 which is defined by the housing of the handling unit. The substrate which is to receive the desired coating is positioned within the region 16, through the opening 22.

The fluid handled within the unit 14 is the same fluid (i.e., air) as is contained within the outer enclosure 12. However, the fluid handled within the unit 14 is filtered, regulated and maintained at a controlled humidity and/or temperature, unlike the fluid contained in the surrounding outer enclosure 12. The temperatures and humidities within the outer enclosure 12 can vary freely (but will generally be on the order of 65–80° F. and 25–40% RH) while the temperatures and humidities in the environment surrounding the substrate (in the region 16) will generally be fixed to within a range of 5° F. and 5% relative humidity about that temperature and humidity required for the process being performed.

The exact temperature and humidity with unit 14 can vary freely responsive to the types of coatings being sprayed. For example, apart from the application of chromate/phosphate coatings to substrates, as previously described, the present invention is well adapted for the application of waterborne paints (including solvents), solvent based coatings (organic or aqueous), dispersions in aqueous or non-aqueous systems and thermal spray coatings in which materials such as metals and ceramics are thermally processed into coating films. The invention is well suited for the variety of novel coatings which are being developed to meet the increasingly demanding requirements of industry and to conform to national or federal safety regulations.

The handling unit 14 includes a recirculation system for producing a flow of the fluid at a predetermined temperature and/or humidity. This flow is initiated through an inlet 24 located above the substrate (as shown by arrows 26), to an outlet 28 located below the substrate. This is commonly referred to as a downdraft flow. A suitable gradient of humidity and/or temperature is maintained between the outer enclosure 12 and the handling unit 14. Under normal operating conditions, the fluid from the outer enclosure 12 does not significantly mix with the fluid circulating within the handling unit 14 because the fluid in the handling unit 14 is recirculated and substantially constant in volume.

A substrate to be coated is supported on a substrate platform 30. The opening 22 allows access from the outer enclosure 12 to the substrate platform 30, in addition to providing fluid communication between the handling unit 14 and the outer enclosure 12. A filter 32 is disposed over the inlet 24 and a filter 34 is disposed over the outlet 28. If desired, a pre-filter 36 may be disposed over the filter 34. The filters 34, 36 are located below the substrate to remove overspray from the air flow. These filters further remove airborne particulates. Such filters function in layers and can be composed of many different materials, provided the selected filter media will not be attacked by the atomized particles being sprayed. Examples of such filters include metallic types, such as stainless steel mesh or wool, or paper types, such as are commonly used in existing spray booths. However, paper or similar materials are not recommended because the used filters become waste, often hazardous waste because of the heavy metals such filters trap. It is preferable to use filter media that are reusable and as highly efficient as possible.

For example, the filter 36 (which is exposed to the coalescing stream of overspray) is preferably the most porous and open filter in the system. A washable fiberglass filter mat is most suitable for this, although other, washable open-weave filters can be used. The filter 34 is preferably denser in construction, and can be formed of fiberglass, nonwoven polyethylene or some other polyolefin. The filters 36, 34 are preferably inert and washable, and various other types (other than those identified above) may be used if desired. The filter 32 filters the downdraft flow of fluid over the substrate, and assures a uniform downward wash of laminar flow across the substrate. The filters 36, 34, 32 may be washable filters, if desired.

The region 16 defined by the handling unit 14 between the filter 32 and the filter 36 (and the pre-filter 34, if used) defines a coating chamber in which the substrate is placed. It is only within this coating chamber that it is critical to control temperature and/or humidity to ensure the quality of the coating provided on the substrate.

A fluid flow column 40 extends between the inlet 24 and the outlet 28. A fan 42 is provided to create a flow of fluid into and out of the region 16. Generally, a variable speed fan 42 is used for such purposes. A disposable overspray filter can be provided to remove (generally up to 99%) of the overspray, if desired.

The column 40 further includes a filter 44 for removing toxic and hazardous contaminants from the fluid flow which is developed. This can include carbon cells and bag filters, or other suitable filter devices. Carbon (activated charcoal) cells remove organic solvents from the stream of fluid flow. Bag filters are used to remove airborne particulates from the air flow, and to "polish" the air by removing remaining contaminant particles. An air sampler 48 is optionally provided to continuously detect toxins in the air passing through the filter 44. If levels of these toxins exceed safe operating standards, the system will preferably and automatically shut down until the appropriate filters are changed.

The column 40 further includes equipment 46 for regulating the temperature and/or humidity of the fluid flowing through the column 40 including apparatus for heating the flow, for cooling the flow, for humidifying the flow and/or for de-humidifying the flow. The particular selection or combination of apparatus used will depend upon the conditions of environment in which the spray booth is used (region 18) and the specific environmental requirements of the coating being applied. To this end, column 40 can include a heater, an air conditioner (or a heat pump) which can also serve to dehumidify the flow through the column 40 and/or a humidifier for increasing the humidity of the flow through the column 40, in desired combinations for performing necessary temperature and/or humidity adjustments.

The column 40 is further provided with temperature and/or humidity controls (shown schematically at 50) for regulating the temperature and/or humidity of the fluid flow developed at the inlet 24, for delivery to the region 16, and as will be discussed more fully below, for exhausting a predetermined amount of fluid from the handling unit 14 to the exterior of the outer enclosure 12 in appropriate cases. Fluid is drawn from the outer enclosure 12, through the opening 22 and into the handling unit 14, at a temperature and humidity which is determined by the (unregulated) environment of the outer enclosure 12. As this takes place, an equilibrium is established between the fluid flow developed by the handling unit 14 and the fluid contained in the outer enclosure 12. The fluid flowing through the column 40 (which includes some fluid drawn from the (unregulated) environment in region 18) is filtered and modified in terms of its temperature and/or humidity to provide a curtain of fluid (i.e., an air curtain) for receiving and surrounding the substrate to be coated (or, as will be discussed more fully below, the appropriate portions of a substrate to be coated). Primarily, this is accomplished through operation of the equipment 46, including any heater, air conditioner and/or humidifier selected for use in a particular installation.

As a result of the foregoing, the temperature and/or humidity of the fluid delivered from the handling unit 14 can be freely adjusted, providing a curtain of fluid at a controlled temperature and/or humidity for surrounding the substrate to be coated without requiring control of the temperature or humidity of the enclosure 12 which contains the handling unit 14. This leads to significant reductions in the cost of the installation and in operating the equipment, since the volume of fluid being conditioned in the handling unit 14 is significantly less than the volume of fluid that would have to be conditioned to fill the volume of the outer enclosure 12.

To assure that contaminants are effectively filtered from fluid circulating within the closed loop of the handling unit 14, an on-stream counter 52 is preferably provided to sample the particulate content of the fluid circulating within the handling unit 14 (after that fluid passes through the filters 34, 36, 44). Should this particulate content exceed prescribed threshold limits (predetermined according to air quality standards for the contaminants anticipated in the process), the counter 52 will disable the fan 42 until the filters 34, 36, 44 are cleaned or changed. An example of such an on-stream counter would include those manufactured by Climet, Inc. of Redlands, Calif.

The venting of fluid from the column 40 to the environment external of the outer enclosure 12 is accomplished with a conduit 60 extending between the column 40 and one of the side walls 62 of the outer enclosure 12. An exhaust fan is disposed within the conduit 60 for drawing fluid from the column 40 through the conduit 60 to the exterior of the outer enclosure 12. The conduit 60 preferably terminates in a filter 68 for discharging fluid to the environment.

A temperature and/or humidity sensor 66 is preferably located in the region 16, and is operatively connected to the means (50) for controlling humidifying and/or dehumidifying and heating and cooling the fluid. When the sensor 66 detects a change in temperature and/or humidity which is inconsistent with those levels which are appropriate to yield optimum coating conditions, the equipment which modifies those conditions is appropriately enabled.

An air sampler 70 can optionally be provided on the conduit 60 for sampling the particulate content of the fluid being exhausted through the conduit 60. As discussed previously, if toxins are detected by the air sampler 70 which exceed predetermined levels, the system would be caused to shut down (for cleaning). For example, the air sampler 70 can be used to determine chromium levels in the fluid after the flow has passed through the various filters in the system. When the chromium (+6) is detected, the filters in the system would be removed and washed or replaced. The air sampler 70 can be a constant flow pump (as manufactured by SKC Inc. of Eighty Four, Pa.), using a 5 m PVC filter (per the NIOSH procedure).

In operation, the outer enclosure 12 may be any desired enclosure (including a dedicated room, a tent, or temporary facility) and will exhibit ambient temperature and humidity conditions responsive to the environment receiving the enclosure. Establishing a proper temperature and/or humidity within the region 16, for purposes of accommodating the coatings to be applied, is not dependent upon regulation of the temperature and/or humidity within the region 18 of the outer enclosure 12, but rather is dependent upon operations of the handling unit 14. The temperature and/or humidity may therefore be regulated for purposes other than the application of coatings to substrates (e.g., the comfort of those occupying the structure) if desired.

The fan 42 is operated to circulate the fluid (generally air) through the region 16 from top to bottom creating a downdraft flow. An operator using a hand-held spray gun (schematically shown by the arrow 72) then sprays the desired coating onto a selected substrate using techniques which are themselves known in industry. Fluid continually flows through the handling unit 14, and is filtered and regulated in temperature and/or humidity so that the temperature and/or humidity within the region 16 is maintained at a desired, predetermined level suitable for application of the coating to the substrate. Clean (filtered) fluid within the column 40 may be vented to the environment external of the outer enclosure 12, if needed. This exhausted fluid is in turn replaced by fluid drawn from the outer enclosure 12. As result of the foregoing, locally regulated temperatures and humidities may be maintained in the vicinity of the substrate to be coated without requiring the careful control of the temperature and humidity levels of the outer enclosure 12 which was required by prior systems.

Figure 2:
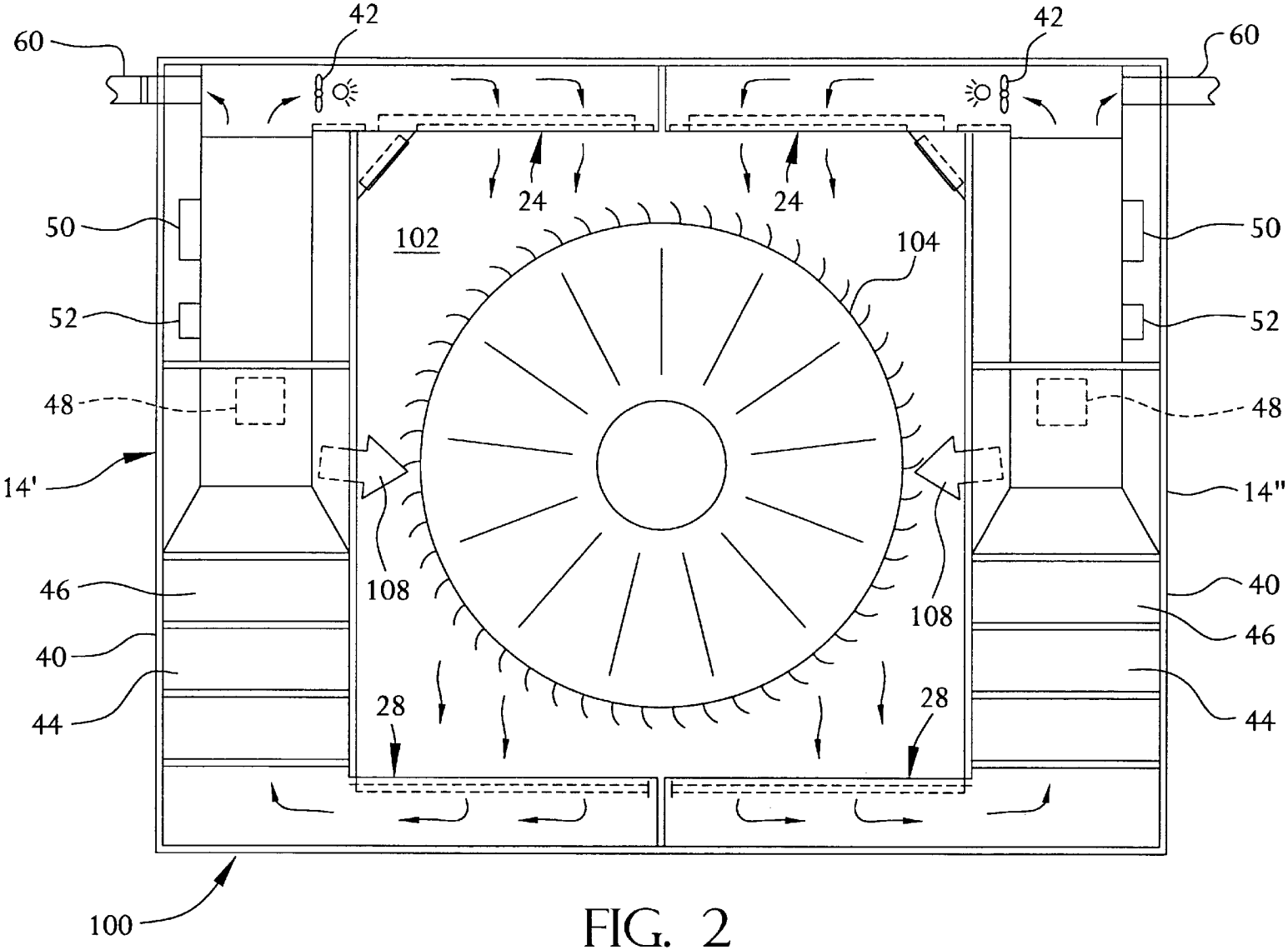
FIG. 2 is a side elevational view of an alternative embodiment spray booth produced in accordance with the present invention.

FIG. 2 shows an alternative embodiment spray booth 100 for applying coatings to substrates of an increased size. The spray booth 100 is primarily intended for use in applying coatings to substrates of a size greater than that of the region 16 defined by the spray booth 10 of FIG. 1, although the spray booth 100 could also serve to receive substrates of a smaller size if desired. However, the attendant costs of operation would be slightly higher in such cases.

The spray booth 100 is generally comprised of two handling units (14', 14" which substantially correspond to the handling unit 14 of the spray booth 10 of FIG. 1, and which are positioned within an appropriate outer enclosure (not shown for ease of illustration). The components comprising the handling units 14', 14" of the spray booth 100 correspond to the components comprising the handling unit 14 of the spray booth 10, and will be combined as desired to accommodate a particular environment and to receive a particular substrate for the application of a selected coating.

The handling unit 14" is preferably formed as a mirror image of the handling unit 14', and is placed in abutting relationship with the handling unit 14' to define a region 102 which is substantially enclosed along its top and lateral edges, yet open at its sides for receiving a substrate 104 to be coated (e.g. the turbine shown). The substrate 104 may either be placed in the region 102, for receiving the desired coating or may be moved through the region 102 as will be discussed more fully below. In any event, the air handling unit 14', 14" combine in operation to develop an air curtain of controlled temperature and/or humidity in the region 102, providing an environment suitable for the application of an effective coating to the substrate 104. The handling units 14', 14" otherwise operate as previously described to provide the desired environment for applying such coatings. In most cases, the sensors and controls associated with the handling units 14', 14" will be interconnected to provide the region 102 with a uniform environment resulting from the combined (cooperating) operations of the two handling units. However, if desired, it is also possible to separately control operations of the handling units 14', 14" to provide two different environmental regimes.

Figure 3:
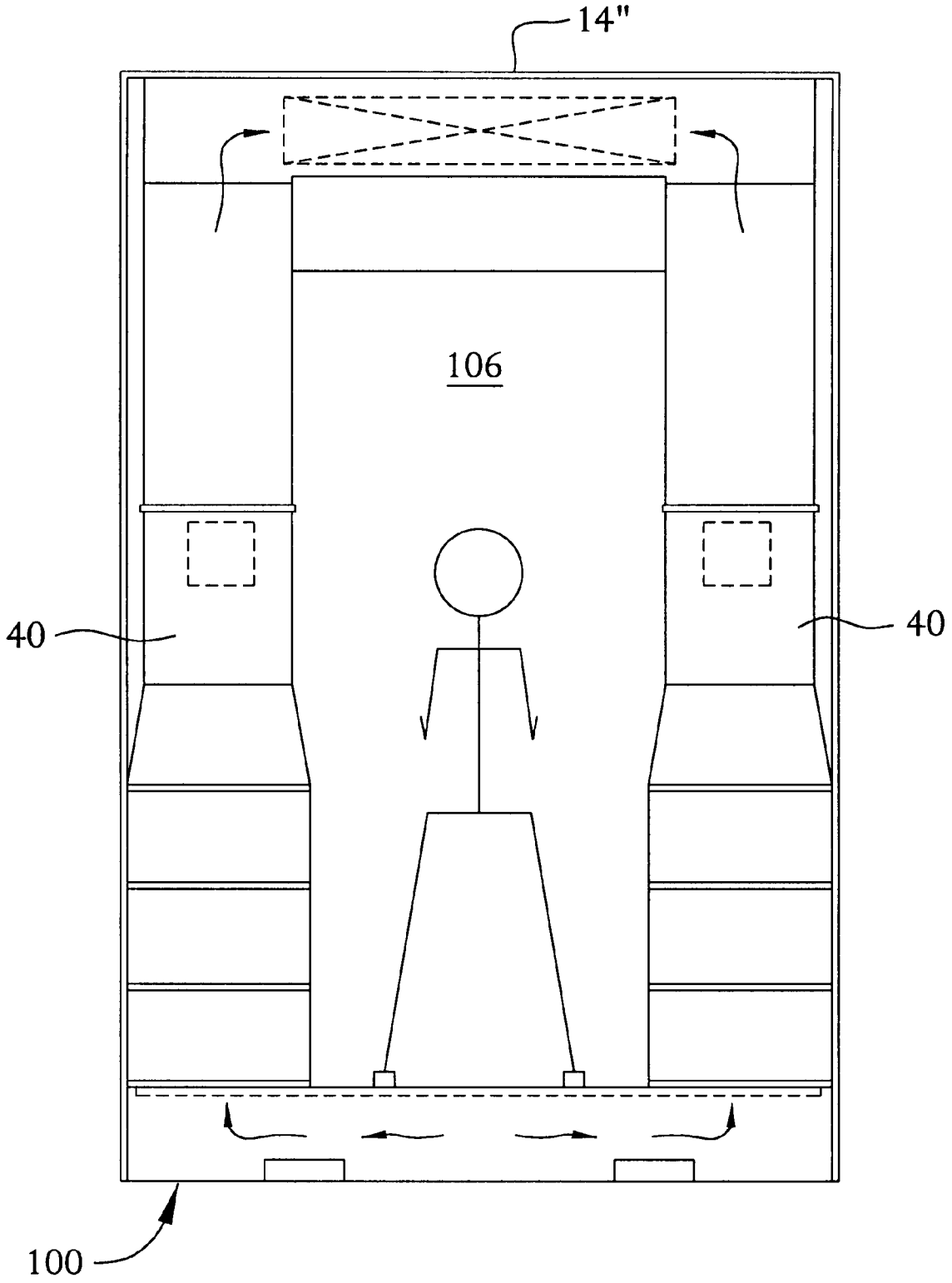
FIG. 3 is an end elevational view of the spray booth of FIG. 2.

FIG. 3 shows the spray booth 100 of FIG. 2 from either side. As shown in this figure, the spray booth 100 includes two fluid flow columns 40 which are substantially similar to the fluid flow column 40 of the spray booth 10. Such a configuration is advantageously provided in situations where increased fluid handling is required to provide an air curtain of sufficient volume, and maintained at desired temperature and/or humidity conditions, in cases where such additional capacity is needed (e.g., when the outer enclosure 12 exhibits relatively extreme conditions). A spray booth having the overall configuration of the spray booth 100 of FIG. 2, but having only a single air flow column 40 at one side, could also be provided where sufficient for the coating operations to be performed. In either case, an operator is advantageously located in the region 106, as shown, so that desired coatings may be applied to the substrate 104 (as is generally represented by the arrow 108 in FIG. 2). In most cases, an operator is advantageously stationed at either side of the substrate 104, to work on separate portions of the substrate and reduce the amount of time needed to complete the desired coating operation.

As previously indicated, some substrates will be of a size significantly larger than the region 16 of the spray booth 10, or even the region 102 of the spray booth 100. This could include large assemblies such as turbines or industrial compressors, or large individual components such as helicopter rotor blades (which may be on the order of 30 feet in length). To limit the volume of fluid that must be filtered, heat or cooled and humidified or dehumidified and hence to limit cost, it is preferable to maintain the size of the regions 16, 102 as small as possible. To this end, and for substrates of a relatively large size, it is preferable to use the spray booths 10, 100 to apply coatings (of the same type, or even of different types) to selected portions of the substrate while establishing relative movement between the substrate and the spray booths 10, 100. In this way, desired coatings may be applied to the entire substrate irrespective of its length.

Figure 4:
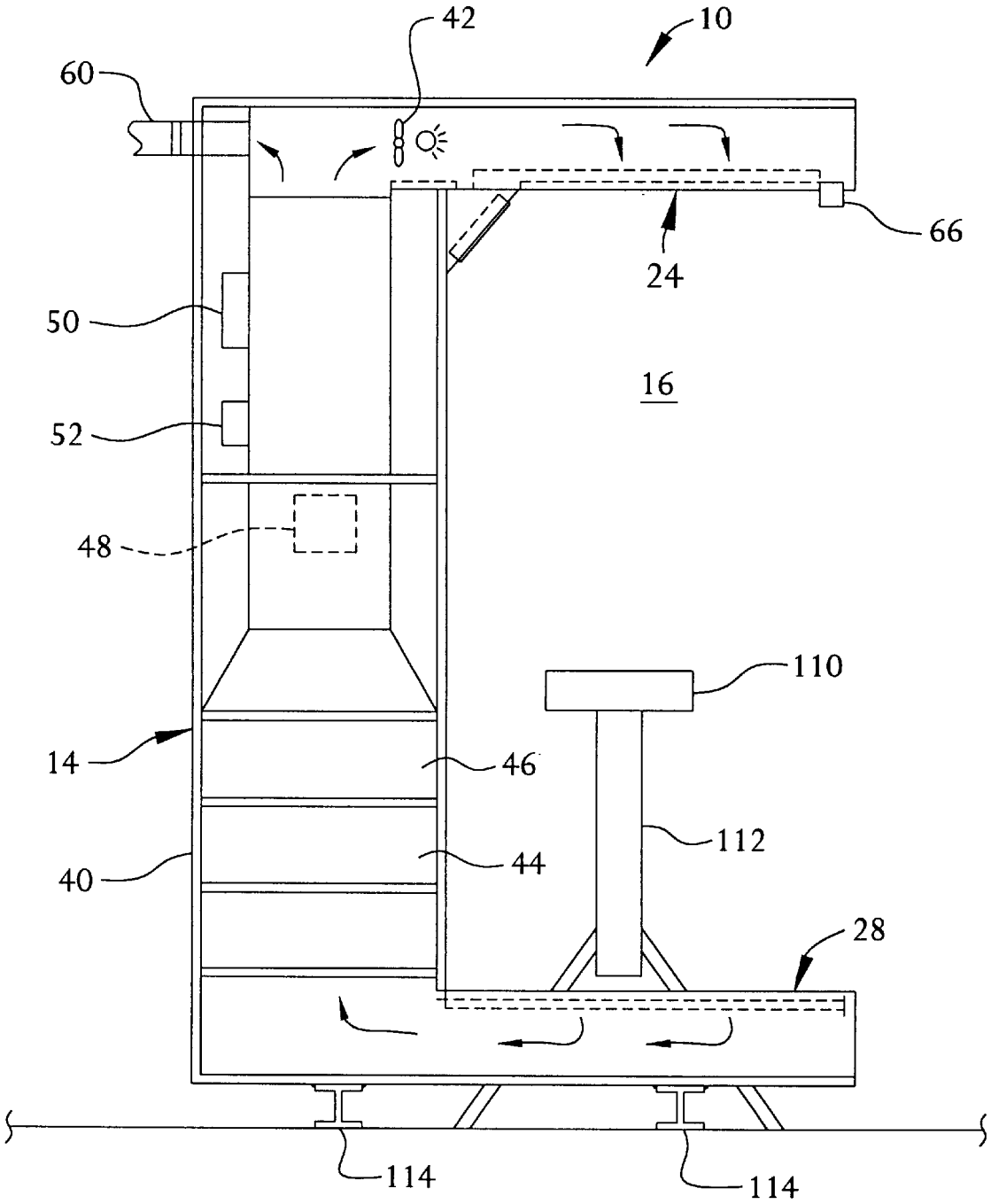
FIG. 4 is a side elevational view of a first alternative embodiment of a spray booth produced in accordance with the present invention which is capable of use in applying coatings to substrates of a larger size.

FIG. 4 shows a first alternative embodiment for establishing relative movement between a spray booth 10 and an elongate substrate 110. In this embodiment, the elongated substrate 110 is fixed in position (e.g. on jackstands 112 or the like) so that the substrate 110 extends traversely from the spray booth 10, and through the region 16. The spray booth 10 is mounted on rails 114 and is provided with a suitable mechanism (e.g., rollers) for causing movement of the spray booth 10 upon and along the rails 114, in a direction which generally parallels the substrate 110. Mechanized movement of the spray booth 10 along the rails 114 can be accomplished, if desired, with an appropriate drive.

In operation, the spray booth 10 is moved into position along the substrate 110 to provide an air curtain for the application of an appropriate coating to a selected region of the substrate 110. The spray booth 10 is serially moved along the rails 114 to address other portions of the substrate 110, so that desired coatings may be applied to the portion of the substrate 110 then located within the environmentally controlled region 16. This procedure can be continued, irrespective of the length of the substrate, to apply coatings (of a similar type or of different types, including different types of coatings for different portions of the substrate) either to the entire substrate or to selected portions of the substrate, as desired. To be noted is that in such cases, connections with the spray booth 10 (including electrical, mechanical and air vent connections) will have to be made sufficiently flexible to allow for movement of the spray booth 10 along its desired path.

Figure 5:
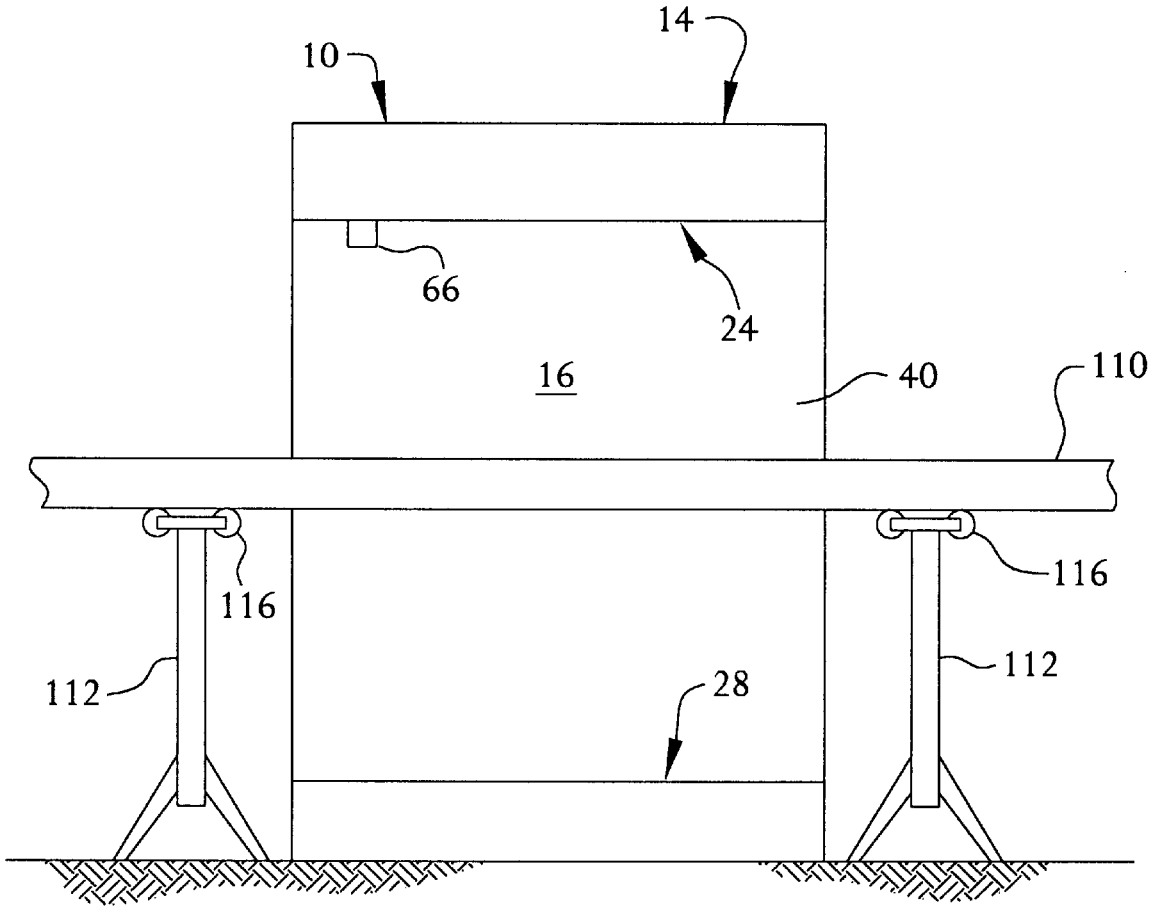
FIG. 5 is an end elevational view of a second alternative embodiment spray booth for use in applying coatings to substrates of a larger size.

FIG. 5 shows an alternative to the embodiment of FIG. 4, for purposes of applying coatings to a relatively large (in this case, elongated) structure. In this embodiment, a stationary spray booth 10 (similar to the spray booth 10 of FIG. 1) is used, and the elongated substrate 110 is caused to move relative to the spray booth 10. Placement of the substrate 110 relative to the spray booth 10 will be substantially the same as in the embodiment of FIG. 4. The only difference is that relative movement between the spray booth 10 and the substrate 110 will be established by moving the substrate 110 rather than the spray booth 10. Any of a variety of mechanisms may be used for such purposes, such as the roller assemblies 116 shown. Again, such movement may be mechanized, if desired.

In any event, desired portions of the substrate 110 are caused to pass through the region 16, establishing a controlled environment suitable for the application of selected coatings to those portions of the substrate 110 then positioned within the region 16. This is continued for other portions of the substrate 110, until all desired portions of the substrate 110 are suitably coated.

The present invention can be used in conjunction with any air or airless spray application technique. However, it has been determined that high volume low pressure spray methods (known as HVLP) are preferred. It has been found that such spray techniques maximize transfer efficiency and reduce air flow requirements in coating operations, such as those used for applying the coatings disclosed in U.S. Pat. No. 3,248,251 discussed above.

It should be noted that the invention has been described in an illustrative manner only, and it should be understood that the terminology which has been used is intended to be descriptive rather than limiting. It should also be understood that many modifications and variations of the present invention are possible in light of the above teachings.

What is claimed is:

1. A spray booth for applying a coating to a substrate, the spray booth comprising:

a fluid handling unit adapted to be positioned within an enclosure containing a fluid that is unregulated in humidity relative to the humidity of fluid outside of the enclosure, the fluid handling unit defining an open region between an outlet and an inlet of the fluid handling unit, the open region being open on at least one side to the enclosure to allow fluid to flow freely between the open region and the enclosure, wherein the fluid handling unit includes a housing extending from the outlet which draws fluid from the open region to the inlet which delivers fluid to the open region, and wherein the housing includes;

a fan which causes circulation of the fluid from the outlet to the inlet, a filter in line with the flow of fluid through the housing, wherein the filter cleans the fluid passing through the fluid handling unit, a humidifier adapted to increase the humidity of fluid passing through the housing, and a dehumidifier adapted to decrease the humidity of fluid passing through the housing and recirculate the dehumidified fluid into the open region of the fluid handling unit via the inlet;

wherein the open region is sized to receive at least a portion of the substrate so that the portion of the substrate is maintained within a curtain of the fluid extending between the inlet and the outlet having a humidity regulated so that the coating can be effectively applied to the substrate while positioned within the open region.

2. The apparatus of claim 1 which further includes an air cleaner in communication with interior portions of the enclosure.

3. The apparatus of claim 1 wherein the housing further includes an air conditioner or a heat pump.

4. The apparatus of claim 1 wherein the housing further includes a heater.

5. The apparatus of claim 1 which further includes means for controlling operations of the humidifier and dehumidifier.

6. The apparatus of claim 1 which further includes means for maintaining the fluid within the open region substantially particle-free.

7. The apparatus of claim 5 wherein the controlling means is operatively coupled with the fluid handling unit, for sensing the humidity of the flow of fluid.

8. The apparatus of claim 5 wherein the controlling means is operatively coupled with the flow of fluid through the housing, and operates to control the humidity of the fluid maintained within the fluid curtain.

9. The apparatus of claim 5 wherein the controlling means includes an air sampler operatively coupled with the flow of fluid through the housing, for detecting the presence of toxins in the flow of fluid and for discontinuing operations of the fluid handling unit for detected levels of toxins exceeding a defined threshold.

10. The apparatus of claim 5 wherein the controlling means includes a counter operatively coupled with the flow of fluid through the housing, for counting particulates present in the flow of fluid and for discontinuing operations of the fluid handling unit for counts exceeding a defined threshold.

11. The apparatus of claim 1 wherein the filter is a carbon cell placed in line with the flow of fluid through the housing.

12. The apparatus of claim 1 wherein the filter is a bag filter placed in line with the flow of fluid through the housing.

13. The apparatus of claim 1 which further includes a first filter disposed over the inlet communicating with the open region.

14. The apparatus of claim 1 which further includes a second filter disposed over the outlet communicating with the open region.

15. The apparatus of claim 14 which further includes a pre-filter disposed over the second filter.

16. The apparatus of claim 1 wherein the fluid handling unit is adapted to entrain the fluid at the outlet of the fluid handling unit at a first rate of flow and to discharge the fluid from the inlet of the fluid handling unit at a second rate of flow, wherein the first rate of flow is greater than the second rate of flow.

17. The apparatus of claim 16 which further includes a conduit which extends between the flow of fluid within the housing and external portions of the enclosure, wherein the conduit establishes fluid flow between the housing and the external portions of the enclosure.

18. The apparatus of claim 1 which further includes an exhaust conduit extending between the housing of the fluid handling unit and exterior portions of the enclosure, wherein the exhaust conduit includes a fan which causes circulation of a portion of the fluid from within the housing of the fluid handling unit to the exterior portions of the enclosure.

19. The apparatus of claim 18 which further includes an ambient condition sensor operatively coupled with the flow of fluid through the housing, and the fan of the exhaust conduit, which controls operations of the fan responsive to detected changes in the ambient conditions.

20. The apparatus of claim 18 wherein the exhaust conduit further includes an air sampler operatively coupled with the exhaust conduit, for counting particulates present in fluid flowing through the exhaust conduit and for discontinuing operations of the fluid handling unit for counts exceeding a defined threshold.

21. The apparatus of claim 1 wherein the fluid handling unit is further adapted to regulate the flow of fluid in temperature level.

22. The apparatus of claim 1 wherein the coating is an aqueous chromate/phosphate slurry.

23. The apparatus of claim 1 wherein the coating is a paint.

24. The apparatus of claim 1 wherein the enclosure is open to the environment surrounding the enclosure.

25. The apparatus of claim 1 wherein the substrate is fully contained within the open region.

26. The apparatus of claim 1 wherein the substrate has a size which exceeds the size of the open region.

27. The apparatus of claim 26 wherein the substrate and the spray booth are movable relative to each other.

28. The apparatus of claim 27 wherein the spray booth is stationary, and wherein the substrate is movable relative to the spray booth.

29. The apparatus of claim 27 wherein the substrate is stationary, and wherein the spray booth is movable relative to the substrate.

30. The apparatus of claim 1 wherein the fluid handling unit includes a pair of housings including the fan, the filter and the regulating means, thereby increasing the capacity of the fluid handling unit.

31. The apparatus of claim 30 which further includes mean for maintaining the fluid substantially particle-free.

32. The apparatus of claim 30 wherein a first fluid handling unit is formed as a mirror image of a second fluid handling unit, and wherein the first and second fluid handling units are juxtaposed to meet and define an open region which is enclosed along top, bottom and lateral edge portions of the open region.

33. The apparatus of claim 32 wherein the first and second fluid handling units are operatively coupled to develop a uniform curtain of the fluid.

34. The apparatus of claim 32 wherein the first and second fluid handling units are operatively separated to develop curtains of fluid having different characteristics at different positions located between the pair of fluid handling units.

35. The apparatus of claim 32 wherein at least one of the pair of fluid handling units includes the fan, the filter and the regulating means, thereby increasing the capacity of said at least one fluid handling unit.

36. The apparatus of claim 35 wherein an operator station is defined between the pair of fluid handling units.

* * * * *